US005106019A

United States Patent [19]

Rizk et al.

[11] Patent Number: 5,106,019

[45] Date of Patent: Apr. 21, 1992

[54] FUEL INJECTOR

[75] Inventors: Reda Rizk, Cologne; Hans-Gottfried Michels, Erftstadt, both of Fed. Rep. of Germany

[73] Assignee: Kloeckner-Humboldt-Deutz AG, Cologne, Fed. Rep. of Germany

[21] Appl. No.: 737,839

[22] Filed: Jul. 29, 1991

Related U.S. Application Data

[63] Continuation of Ser. No. 447,683, Dec. 8, 1989, abandoned.

[30] Foreign Application Priority Data

Dec. 9, 1988 [DE] Fed. Rep. of Germany ..... 3841462

[51] Int. Cl.[5] ..... F02M 47/00

[52] U.S. Cl. ..... 239/90; 239/93

[58] Field of Search ..... 239/88-94, 239/585

[56] References Cited

U.S. PATENT DOCUMENTS

| | | | |
|---|---|---|---|
| 4,129,253 | 12/1978 | Bader | 239/88 |
| 4,408,718 | 10/1983 | Wich | 239/88 |
| 4,475,514 | 10/1984 | List | 239/88 X |
| 4,565,320 | 1/1986 | Taniguchi et al. | 239/88 X |
| 4,572,433 | 2/1986 | Deckard | 239/88 |
| 4,605,166 | 8/1986 | Kelly | 239/88 X |
| 4,653,455 | 3/1987 | Eblen et al. | 239/88 X |
| 4,941,612 | 7/1990 | Li | 239/88 |
| 4,951,874 | 8/1990 | Onishi et al. | 239/88 |

*Primary Examiner*—Andres Kashnikow
*Assistant Examiner*—Kevin P. Weldon
*Attorney, Agent, or Firm*—Charles L. Schwab

[57] ABSTRACT

The fuel injector includes an injection pump element with electromagnetically actuated control valve body supported therein for the control of the beginning of delivery and the quantity delivered. The injection pump element and the control valve are individually replaceable and the control valve body seats without recoil. A control valve (2), which is arranged with clearance in a stepped hole (19) in a plunger bushing (5) is supported in sealing elements (20). The freedom from recoil is achieved by adaptation of a minimum clearance (46) between an anchor plate (30) and an electromagnetic adjusting device (7), the anchor plate (30) being situated in a liquid-filled damping space (33) and the minimum clearance (46) being optimized as a function of the mass of the moving parts of the control valve (2), the spring stiffness of the control valve seat (25), the geometry of an anchor plate (30) and the viscosity of the fuel in the service temperature range.

13 Claims, 2 Drawing Sheets

FUEL INJECTOR

This application is a continuation of application Ser. No. 07/447,683, filed Dec. 8, 1989 now abandoned.

TECHNICAL FIELD

This invention relates to a fuel injection mechanism and more particularly to a fuel injection pump.

PRIOR ART STATEMENT

Increasingly stringent requirements as to environmental tolerance and fuel consumption make it desirable to be able to selectly adjust the time of fuel injection into the combustion space of the diesel engine.

A fuel injector that possesses this characteristic is known from European Patent Application 0 114 375. In it, the fuel delivered by the fuel injection pump is controlled by an electromagnetically actuated control valve arranged between the pump plunger and the pressure valve. In this arrangement, in which the control valve body is guided directly in the extended pump plunger bushing, damage to the pump plunger or control valve body always necessitates the replacement of both parts.

An alternative arrangement, with a separate control valve cover on the injection pump element for the mounting of the control valve unit, is expensive and is associated with a substantial additional dead space, which is particularly disadvantageous in the case of high injection pressures. The control valve body of this arrangement, because of its relatively great mass and inadequate damping, has a tendency toward seat recoil. This impairs the accuracy of the onset of delivery and the quantity of fuel delivery is caused to vary between one individual pump element and another.

OBJECTS AND SUMMARY OF THE INVENTION

It is an object of the invention to avoid the disadvantages of the known fuel injector and to create an alternative that is easy to maintain and functionally reliable.

It is a further object of this invention to provide a fuel injector permitting separate fabrication and testing, and individual replacement of the injection pump element, the control valve and the electromagnetic adjusting device.

This invention achieves a reduction in the dead space in the fuel injector.

The control valve of the fuel injector is replaceable by provision of a stepped hole in the injection pump element and the control valve.

This assembly clearance is bridged over in an advantageous manner by two seal elements that, besides their high-pressure sealing function, provide a support of the control valve in the stepped hole in the plunger bushing.

The fuel injector of this invention is so designed that when the high-pressure fuel is spilled by the control valve body, it is led through a hole in the plunger bushing back to the low-pressure space thus avoiding external connecting lines with their inherent danger of leakage.

The elements with which the control valve is fastened to the plunger bushing are arranged parallel to the axis of the control valve body. This arrangement prevents distortion and attendant seizing of the control valve body in the control valve bushing.

A spill groove in the pump plunger permits the delivery of the injection pump to be interrupted, independently of the operation of the control valve, before the dome radius of the injection pump cam engages the pump plunger during its delivery stoke.

By means of the arrangement of the anchor plate in a vented and fuel-filled space in accordance with the invention, recoilless closing and thus exact control of the beginning of fuel delivery and of the quantity of fuel delivered is achieved, provided the clearance between the anchor in its picked-up state and the electromagnetic adjusting device is adapted to the various design parameters of the control valve.

The provision of a longitudinal and transverse leakage oil hole in the control valve body avoids the need for a separate leakage oil return line, the expense associated therewith, and the danger of leakage.

The injection pump element fabricated in accordance with this invention permits replacement of a standard element with the injection pump element with the control valve of this invention without any reworking.

The position of the high-pressure space and the suction or spill hole in accordance with this invention makes possible a minimal dead space in the high-pressure region, which is comparable with the dead space of a standard element.

BRIEF DESCRIPTION OF THE DRAWINGS

Other features of the invention are derived from the following description of the drawings of one embodiment of the invention in which.

DETAILED DESCRIPTION OF THE DRAWINGS

Figure 1:
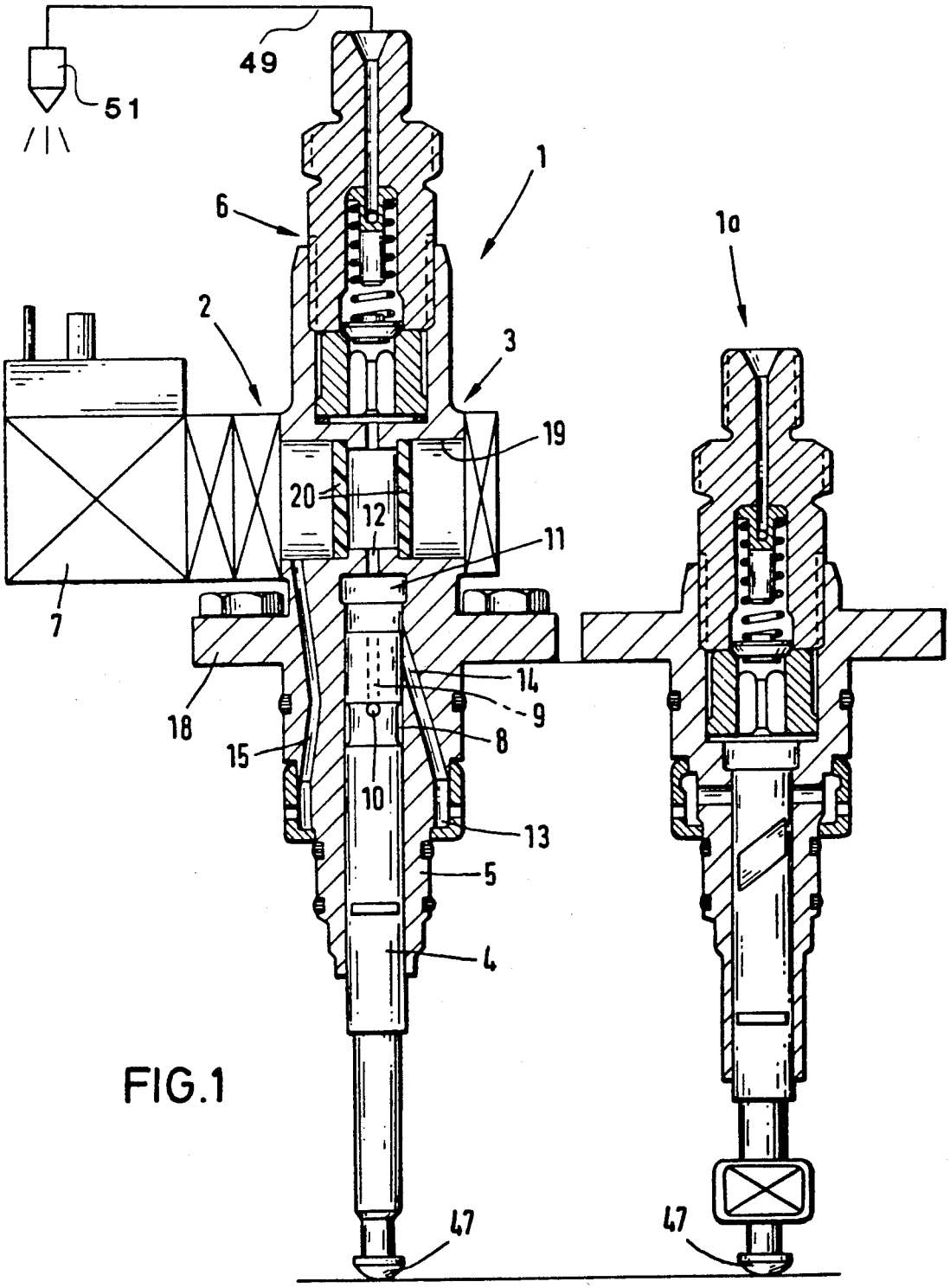
FIG. 1 shows a transverse section through a fuel injection pump of this invention and through a standard injection pump.
Figure 2:
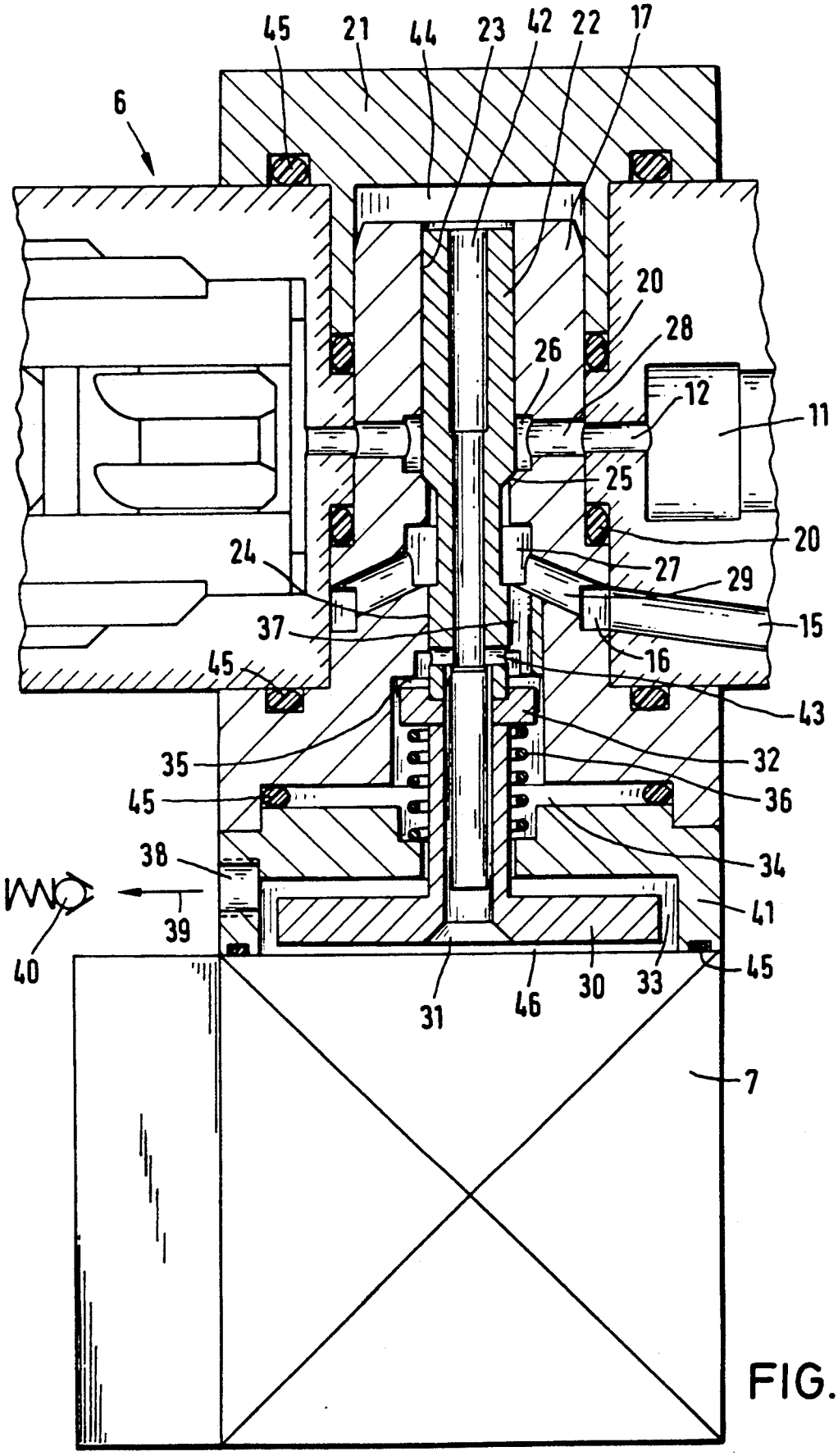
FIG. 2 shows a detailed section through control valve of the fuel injection pump shown in FIG. 1.

The fuel injection pump consists of an injection pump element 1 and a control valve 2, the injection pump element or unit 1 simultaneously being the carrier of the control valve 2. The injection pump element is assembled from a pump plunger 4, a plunger bushing 5 and a commercial relief valve 6; the control valve 2, from a control valve element 3 and an electromagnetic adjusting device 7.

The pump plunger 4, which is sealingly guided in the plunger bushing 5, is moved by a cam, not illustrated, via a roller shaft, likewise not illustrated, in the direction of the pump plunger axis. The pump plunger 4 has a spill groove 8, which is connected to a high-pressure space 11 via a longitudinal spill hole 9 and a transverse spill hole 10.

The high pressure space 11 is connected to the relief valve 6 via a high-pressure hole 12 and the control valve element 3 and is further connected, via an injection line 49 to a fuel injection valve 51.

The high-pressure space 11 is extended up to a short way below a stepped hole 19, which serves to accommodate the control valve 2. By this means, the dead space between high-pressure space 11 and relief valve 6 is minimized, which proves especially advantageous at high injection pressures. Any difference in dead space over a standard element 1*a* due to the high-pressure hole 12 and the high-pressure control hole 28 can be compensated by adaptation of the injection line length.

The high-pressure space 11 has no cover plate because the injection pump element 1 is embodied as a so-called "monoelement". The embodiment as a monoelement advantageously increases the high-pressure capability of the fuel injector by minimizing the pressure space expansion.

In the plunger bushing 5 there is a suction or spill hole 14, which connects the high-pressure space 11 to a low-pressure space 13, which in turn is connected to the suction space, not illustrated, of the injection pump housing.

The suction spill hole 14, in distinction to the standard element 1*a*, is drilled from the low-pressure space obliquely in the direction of the high-pressure space 11 in order to allow for the altered position of the high-pressure space 11.

The low-pressure space 13 is, furthermore, connected to an annular space 16 in a control valve bushing 17 of the control valve element 3 via a return hole 15. By this means, an external return line and attendant construction expense, and a leakage risk, is avoided.

The injection pump element 1 has a pump element flange 18 by which the injection pump element 1 is attached to the pump housing, not illustrated. The dimensions of the pump element flange 18 and the exterior outline of the plunger bushing 5 in the region of the pump housing correspond to the outline of a standard injection pump element 1*a*.

The pump plunger 4 is adapted to the altered position of the high-pressure space 11 by means of an appropriate change in its length, so that, as can be seen in FIG. 1, the position of a pressure head 47 of both injection pump elements is the same when the pump plunger is positioned at bottom dead center. Since, furthermore, the structural width of both injection pump elements coincides, interchangeability is possible without rework. Both injection pump elements are therefore suitable for block and individual injection pumps.

The control valve element 3 seats with a clearance fit in the stepped hole 19 of the plunger bushing 5 and is supported in two high-pressure sealing elements or o-rings 20. It is held in a firm connection with the plunger bushing 5 by means of screws, not illustrated, which are inserted through holes in a cover plate 21 and the plunger bushing 5 and screwed into the control valve bushing 17, without the control valve element being distorted. Furthermore, distortion and consequently seizing of the control valve element 3 caused by the tightening of the relief valve 6 or of the injection line, not illustrated, is avoided by means of an assembly clearance between the control valve bushing 17 and the stepped hole 19.

A particular advantage of this invention resides in the independent replaceability of control valve 2 and injection pump element 1, as well as the adjusting device 7. Low-cost fabrication and repair of the fuel injector is possible by virtue of this modular construction.

The control valve element 3 has a control valve bushing 17 and a control valve body 22, which is axially movably guided in the control valve bushing 17 and, more specifically, in a hole-pressure cylindrical guide surface 23 and a low-pressure cylindrical guide surface 24.

With a control valve seat 25, the control valve body 22 separates a high-pressure annular space 26 from a low-pressure annular space 27. The high-pressure annular space 26 is connected to the high-pressure space 11 or the relief valve 6 via a high-pressure control hole 28 and the high-pressure hole 12. The low-pressure annular space 27 is connected to the low-pressure space 13 via the spill hole 29, the annular space 16 and the return hole 15.

The control valve body 22 had a longitudinal leakage fuel hole 42 and a transverse leakage fuel hole 43, which create a connection between a leakage fuel space 44 and a spring space 34.

At the end of the control valve body 22 where the low-pressure guide surface 24 is located, there is attached an anchor plate 30, which is moved by the electromagnetic adjusting device 7. The attachment of the anchor plate 30 is accomplished by means of a countersunk screw 31 screwed into the control valve body 22, which screw clamps the anchor plate 30 and a stop ring 32 axially against the control valve body 22.

The anchor plate 30 is located in a fuel-filled damping space 33, which is defined by an intermediate piece 41 and the electromagnetic adjusting device 7. The volume of the damping space 33 is sized such that, upon the axial movement of the anchor plate 30, no marked flow resistances occur between the anchor plate 30 and the walls of the intermediate piece 41.

The damping space 33 is connected to a spring space 34, likewise fuel-filled. In the spring space 34 there is a spring 36, whose force presses the stop ring 32 in the direction of the stop 35. The stop 35 serves to limit the stroke of the control valve body 22.

The damping space 33 and the spring space 34 are connected to the spill hole 29 via a choke hole 37.

In the region of the highest point of the damping space 33, in the installed position of the control valve 2, a tapped hole 38 is formed to which a venting or fuel return line 39 is connected, which line leads to the fuel tank, not illustrated.

Arranged in this venting or fuel return line 39 is a pressurizing valve 40, whose spill pressure is lower than the delivery pressure of the fuel pump.

The electromagnetic adjusting device 7 with the intermediate piece 41 is clamped against the control valve bushing 17 by means of screws, not illustrated, which act parallel to the axis of the control valve body 22, without distorting said control valve bushing.

The entire low-pressure region of the control valve 2 is sealed off by means of O-rings 45.

OPERATION

The fuel injector functions in the following manner:

Upon the delivery stroke, the pump plunger 4 is moved from its bottom dead center position in the direction of the control valve unit 2. After running through a pre-stroke, it first closes the suction and spill hole 14. Afterward, the plunger 4 delivers fuel into the high-pressure hole 12 and into the high-pressure control hole 28.

As long as the control valve body 22 with the stop ring 32 and the anchor plate 30 is held against the stop 35 by the spring 36, the high-pressure annular space 26 and the low-pressure annular space 27 are connected via the control valve seat 25. By this means, the fuel delivered flows via the spill holes 29, the annular space 16 and the return hole 15 back into the low-pressure space 13.

As soon as the electromagnetic adjusting device 7 is excited or energized by a current pulse, the anchor plate 30 is picked up. By this means, the control valve body 22 is pulled against the control valve seat 25, by which means the delivery of fuel is begun to the relief valve 6 and, further, via the injection line, not illustrated, to the injection nozzle, not illustrated.

Simultaneously with the picking up of the anchor plate 30, the spring 36 is compressed. As soon as the electromagnetic adjusting device 7 ceases to carry a current, the spring 36 lifts the control valve body 22 off its seat 25. By this means, the fuel again flows into the low-pressure spaces, and fuel injection is terminated.

A precondition for the precise functioning of the control valve 2 and thus for reproducible beginning of delivery and invariant quantity delivered, is the recoilless contact of the control valve body 22 on the control valve seat 25. This is achieved in accordance with the invention by means of a finely tuned damping of the movement of the control valve body 22. The displacement flow between the anchor plate 30 and the electromagnetic adjusting device 7 is utilized for damping. The anchor plate is made with no open axial holes, in order to bring about the most effective possible restricted flow between the anchor plate 30 and the electromagnetic adjusting device 7 at the stroke end.

The requisite degree of damping depends on, among other factors, the moving mass, that is, the mass of the control valve body 22 plus anchor plate 30 plus countersunk screw 31 plus stop ring 32 plus a portion of the mass of the spring 36. Another factor relevant to damping is the spring stiffness of the control valve seat 25.

The damping itself depends on, among other factors, the fuel viscosity, the geometry of the anchor plate 30 and the minimum spacing 46 between the anchor plate 30 and the electromagnetic adjusting device 7, as well as on the pressure in the damping space. These independent variables must be adapted to one another. The optimal adaptation is achieved when the contact of the control valve body 22 on the control valve seat 25 just takes place without recoil and the prolongation of the movement of the control valve body 22 due to damping is minimized.

The provision of the damping space 33 with damping liquid, for example damping oil, can be accomplished via a separate damping oil circuit. In the present case, in accordance with the invention, fuel is withdrawn from the low-pressure region, especially from the spill hole 29 of the control valve 2, and indeed via the choke hole 37. This prevents pressure shocks in the spill hole 29 from reaching the damping space 33.

For proper functioning of the damping, it is important that there is no air in the damping space 33, since the viscosity and compressibility of the damping medium are influenced by such air. What is more, it is important that the damping liquid is continuously renewed, since said liquid becomes heated and ages.

In accordance with the invention, the venting of the damping space 33 is effected via the tapped hole 38, which is made in such a fashion that it is located in the region of the highest point of the damping space 33 in the installed position of the control valve 2.

Connected to the tapped hole 38 is the venting or fuel return line 39, by means of which the fuel flows via the pressurizing valve 40 back to the fuel tank, not illustrated. The pressurizing valve 40 insures a certain liquid pressure in the damping space 33, which pressure is lower than the maximum delivery pressure of the low-pressure pump, not illustrated, and is lower than the pressure in the low-pressure spaces of the fuel injector. By this means, flow through the damping space 33 and thus renewal of the damping medium fuel and cooling of the control valve 2 is insured. Additionally, the pressurizing valve 40 insures that the damping space 33 cannot run dry with the engine stopped, which leads to undamped stroke motion and thus to seat recoil of the control valve 3. This results in, among other things, incorrect beginning of delivery upon restarting of the motor.

The leakage oil or fuel from the leakage fuel space 44 is led, via the longitudinal leakage fuel hole 42 and the transverse leakage fuel hole 43 in the control valve body 22, to the spring space 34 and thus into the damping fuel circuit. This approach in accordance with the invention saves a separate leakage fuel return line.

In the event of a failure of the control valve 2, the spill groove 8 of the pump plunger 4 allows spilling of fuel into the suction or spill hole 14 at the end of the delivery stroke. Thus the fuel injection is terminated in every case before the delivery reaches the dome region of the injection pump cam and overloads it.

The pump plunger 4 of the injection pump element 1 is substantially easier to fabricate than that of the standard element 1*a*, since the rotation means and the precise control faces become unnecessary.

The fuel injector in accordance with the invention allows an exact determination of the onset of delivery and metering of the quantity of injected fuel by means of the recoilless contact of the control valve body 22 on the control valve seat 25. What is more, it is easy to fabricate and service, since the principal components, injection pump element 1, control valve 2 and electromagnetic adjusting device 7, can be fabricated, tested and replaced individually and independently of one another.

The embodiments of the invention in which an exclusive property or privilege is claimed are defined as follows:

1. A fuel injector mechanism for delivering fuel to a fuel injector of a diesel engine having at least one injection pump element (1), a plunger bushing (5) in which a pump plunger (4) is axially guided and sealingly closes off a high-pressure space (11), and having a control valve (2) arranged between the high-pressure space (11) and a relief valve (6) connected in fuel delivery relation to said fuel injector, said control valve (2) including a control valve bushing (17), a valve body (22) axially movably guided in said bushing, an electromagnetic adjusting device (7) and a spring (36) having an axial thrust transmitting connection with said valve body (22) whereby said spring is operable to axially move the latter, a low-pressure annular space (27) in said control valve bushing (17), a low-pressure space (13) connected to said low-pressure annular space (27) and a stepped hole (19) for the accommodation of said control valve (2) formed in said plunger bushing (5) perpendicular and centrally to the axis of said pump plunger (4) and with a slight spacing above said high-pressure space (11).

2. The fuel injector mechanism of claim 1 wherein said control valve (2) has a predetermined clearance in said stepped hole (19) and further comprising a pair of axially spaced annular sealing elements (20) between said control valve (2) and said stepped hole (19).

3. The fuel injector mechanism of claim 1 and further comprising a high-pressure control hole (28) in said control valve bushing (17) and sealing elements (20) disposed between said control valve bushing (17) and said stepped hole (19) on opposite sides of said high-pressure control hole (28) in said control valve bushing (17).

4. The fuel injector mechanism of claim 1 and further comprising a return hole (15) in said plunger bushing (5) connecting said low-pressure annular space (27) with said low-pressure space (13).

5. The fuel injector mechanism of claim 1 and further comprising fastening elements securing said control valve (2) to said plunger bushing (5) with a fastening force acting parallel to the direction of the axis of said control valve body (22).

6. The fuel injector mechanism of claim 1 wherein said pump plunger (4) includes a spill groove (8), a longitudinal spill hole (9) communicating at one of its ends with said high-pressure space (11) and a transverse spill hole (10) interconnecting said longitudinal spill hole (9) with said spill groove (8) and further comprising a spill hole (14) in said plunger bushing (5), said spill groove (8), said longitudinal spill hole (9) and said transverse spill hole (10) serving at the end of the delivery stroke of said pump plunger (4) to connect said high-pressure space (11) to said spill hole (14).

7. The fuel injector of claim 1 wherein said control valve (2) includes a liquid-filled damping space (33) and further comprising an anchor plate (30) on one end of said valve body (22) disposed in said damping space (33).

8. The fuel injector mechanism of claim 1 and further comprising a longitudinal leakage oil hole (42) and a transverse leakage oil hole (43) formed in said valve body (22), said longitudinal and transverse leakage oil holes (42, 43) being interconnected.

9. The fuel injector mechanism of claim 1 wherein said plunger bushing (5) includes a mounting flange (18) and wherein said high-pressure space (11) extends above said mounting flange (18).

10. The fuel injector mechanism of claim 7 wherein said control valve bushing (17) includes a control valve seat (25), said valve body (22) and said anchor plate (30) have a predetermined mass, said spring (27) exerts a predetermined force, said anchor plate (30) has a predetermined shape, said fuel has a predetermined viscosity in a service temperature range, said electromagnetic adjusting device is operative to exert a predetermined force, and a predetermined clearance is provided between said anchor plate (30) and said electromagnetic adjusting device (7) whereby said valve body (22) contacts said control valve seat (25) without substantial recoil when said electromagnetic adjusting device (7) is actuated.

11. A diesel engine fuel injector mechanism for pumping fuel to a fuel injector comprising:

a vertically disposed plunger bushing (5) having a horizontal mounting flange (18) extending outwardly from an intermediate part of said plunger bushing (5), a plunger bore with a high-pressure space (11) at its upper end disposed in part above said flange (18), a high-pressure hole (12) connected to and extending upwardly from said high-pressure space (11) for conveying fuel at injection pressures to said fuel injector and a transverse horizontal hole (19) intersecting said high-pressure hole (12) in slightly spaced relation to said high-pressure space (11), a pump plunger (4) in guided sealing relation to said pump bore and a control valve (2) positioned in said horizontal hole (19) including a control valve bushing (17), a low-pressure annular space (27) in said control valve bushing (17), a valve body (22) axially guided in said plunger bore of said control valve bushing (17) for axial movement between an open position in which said high-pressure hole (12) is in fuel flow communication with said low-pressure space (27) and a closed position in which fuel does not flow from said high pressure hole (12) to said low-pressure space (27) and an electromagnetic adjusting device (7) selectively operable to control the axial position of said valve body (22).

12. A fuel injector mechanism for delivering fuel to the fuel injector of a diesel engine having at least one injection pump element (1), a plunger bushing in which (5) a pump plunger (4) is axially guided and sealingly closes off a high-pressure space (11), and having a control valve (2) arranged between the high-pressure space (11) and a relief valve (6) connected in fuel delivery relation to said fuel injector, said control valve (2) including a control valve bushing (17), a valve body (22) axially movably guided in said bushing, an electromagnetic adjusting device (7) and a spring (36) having an axial thrust transmitting connection with said valve body (22) whereby said spring is operable to axially move the latter, a low-pressure annular space (27) in said control valve bushing (17), a low-pressure space (13) connected to said low-pressure annular space (27), a stepped hole (19) for the accommodation of said control valve (2) formed in said plunger bushing (5) with a slight spacing above said high-pressure space (11), a fuel filled damping space (33) in said control valve (2), a choke hole (37) in said control valve (2) between said damping space (33) and said low-pressure annular space (27), a fuel line connected to the highest point of said damping space (33) and an anchor plate (30) on one end of a control valve body (22) disposed in a damping space (33).

13. The fuel injector mechanism of claim 12 wherein said fuel return line (39) includes a pressurizing valve (40) whose opening pressure is lower than the pressure in said low-pressure annular space of said injection pump element (1).

* * * * *

UNITED STATES PATENT AND TRADEMARK OFFICE

CERTIFICATE OF CORRECTION

PATENT NO. : 5,106,019

DATED : Apr. 21, 1992

INVENTOR(S) : Reda Rizk and Hans-Gottfried Michels

It is certified that error appears in the above-identified patent and that said Letters Patent is hereby corrected as shown below:

Column 8, line 28, after "bushing" insert --- (5) ---;

Column 8, line 29, cancel "(5)".

Signed and Sealed this

Fourteenth Day of September, 1993

Bruce Lehman

*Attest:*

BRUCE LEHMAN

*Attesting Officer*

*Commissioner of Patents and Trademarks*